US006033045A

United States Patent [19]

Roberts et al.

[11] Patent Number: 6,033,045

[45] **Date of Patent: *Mar. 7, 2000**

[54] TRAPEZOIDAL HIDDEN-MONITOR COMPUTER DESK MODULES AND ASSEMBLIES THEREOF

[75] Inventors: Fay D. Roberts, 1821 E. Winchcomb Dr., Phoenix, Ariz. 85022; Debra D. Williamson, Phoenix, Ariz.

[73] Assignee: Fay D. Roberts, Phoenix, Ariz.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/909,410

[22] Filed: Aug. 11, 1997

Related U.S. Application Data

[63] Continuation of application No. 08/909,410, Aug. 11, 1997, which is a continuation of application No. 08/424,955, Apr. 19, 1995, Pat. No. 5,655,822.

[51] Int. Cl.[7] ..... A47B 21/00

[52] U.S. Cl. ..... 312/194; 312/195; 312/223.3; 108/50.01

[58] Field of Search ..... 312/194, 195, 312/196, 198, 223.2, 223.3, 223.6, 236; 108/50.01, 64; 52/36.1, 238.1, 239; 248/917, 918, 923

[56] References Cited

U.S. PATENT DOCUMENTS

| | | | |
|---|---|---|---|
| D. 207,004 | 2/1967 | Carlson | D16/2 |
| D. 233,759 | 11/1974 | Pycha et al. | D14/2 |
| D. 236,351 | 8/1975 | Clayton et al. | D14/2 |
| D. 239,061 | 3/1976 | D'Elia | D6/157 |
| D. 278,956 | 5/1985 | Gordon | D6/422 |
| D. 335,782 | 5/1993 | Lechman et al. | D6/422 |

(List continued on next page.)

FOREIGN PATENT DOCUMENTS

| | | | |
|---|---|---|---|
| 267100 | 5/1963 | Australia . | |
| 1106895 | 8/1981 | Canada . | |
| 1236872 | 5/1988 | Canada . | |
| 145410 | 6/1985 | European Pat. Off. . | |
| 9325117 | 12/1993 | European Pat. Off. | 312/223.2 |
| 9325118 | 12/1993 | European Pat. Off. | 312/194 |
| 577677 | 9/1924 | France . | |
| 2314690 | 6/1975 | France . | |
| 2721307 | 11/1978 | Germany | 312/196 |
| 2839770 | 3/1980 | Germany . | |
| 3003017 | 7/1981 | Germany . | |
| 3308872 | 9/1984 | Germany . | |
| 4100675 | 7/1992 | Germany | 312/223.3 |
| 60-84621 | of 1985 | Japan . | |
| 659370 | 1/1987 | Switzerland . | |
| 619022 | 4/1949 | United Kingdom . | |

*Primary Examiner*—Peter M. Cuomo
*Assistant Examiner*—James O. Hansen
*Attorney, Agent, or Firm*—Cahill, Sutton & Thomas, P.L.C.

[57] ABSTRACT

A computer desk module has a trapezoidal desk top with an opening. A transparent window plate is supported in the desk top so as to cover the opening. A pull-out keyboard shelf is supported under a front edge portion of the desk top. A computer monitor is suspended under the desk top so its screen is inclined upward to allow viewing of the screen through the window plate. A plurality of the computer desk modules are assembled end-to-end into various semi-trapezoidal clusters, S-shaped clusters, and straight line clusters. Overhead power and data bus cables are routed from a classroom ceiling into tubular legs supporting a decorative cover against the ceiling. The legs extend upward from a cabinet having a semi-octagonal shape that mates with a semi-octagonal cluster of the computer desk modules. The cables pass through the legs, through the cabinet, into the various computer desk modules forming the cluster, and to the monitor and a computer in each of the computer desk modules.

22 Claims, 3 Drawing Sheets

U.S. PATENT DOCUMENTS

| | | | |
|---|---|---|---|
| 472,099 | 4/1892 | Wyns . | |
| 536,709 | 4/1895 | Talman . | |
| 549,347 | 11/1895 | Clark . | |
| 861,810 | 7/1907 | Coblentz . | |
| 972,923 | 10/1910 | Ritter . | |
| 1,490,917 | 4/1924 | Finkelstein . | |
| 1,652,774 | 12/1927 | Fraser et al. . | |
| 1,778,163 | 10/1930 | Moore . | |
| 1,996,767 | 4/1935 | Hunter . | |
| 2,341,125 | 2/1944 | Spear . | |
| 2,646,325 | 7/1953 | Abrahamson . | |
| 2,821,450 | 1/1958 | Knoll | 312/111 |
| 2,853,351 | 9/1958 | Bassett | 312/194 |
| 3,021,185 | 2/1962 | Kowalczyk | 312/29 |
| 3,365,259 | 1/1968 | Heisman et al. | 312/194 |
| 3,367,290 | 2/1968 | Barecki | 108/50 |
| 3,658,397 | 4/1972 | Hofmann-lgi | 312/194 |
| 3,688,419 | 9/1972 | Woolman | 108/61 |
| 3,702,209 | 11/1972 | Moore | 312/196 |
| 3,770,334 | 11/1973 | Weber | 312/223.2 |
| 3,778,911 | 12/1973 | Woolman | 52/234 |
| 3,869,992 | 3/1975 | Kramer | 108/60 |
| 3,940,136 | 2/1976 | Runte | 248/917 X |
| 4,073,556 | 2/1978 | Wilson, Jr. . | |
| 4,111,506 | 9/1978 | Gorkiewicz | 312/211 |
| 4,313,112 | 1/1982 | Foster . | |
| 4,314,734 | 2/1982 | Grunert | 312/322 |
| 4,316,082 | 2/1982 | Fritz . | |
| 4,345,803 | 8/1982 | Heck | 312/194 |
| 4,372,515 | 2/1983 | Noonan | 248/178 |
| 4,378,727 | 4/1983 | Doss | 108/50 |
| 4,382,643 | 5/1983 | Heinrich | 312/195 |
| 4,410,159 | 10/1983 | McVicker et al. | 248/349 |
| 4,428,631 | 1/1984 | Cope et al. | 312/194 |
| 4,449,762 | 5/1984 | Turner | 312/196 |
| 4,453,689 | 6/1984 | Ellis et al. | 248/288.1 |
| 4,458,961 | 7/1984 | Browning | 312/196 |
| 4,483,572 | 11/1984 | Story | 312/196 |
| 4,561,619 | 12/1985 | Robillard et al. | 248/285 |
| 4,562,482 | 12/1985 | Brown . | |
| 4,590,866 | 5/1986 | Schairbaum | 312/223.3 |
| 4,637,666 | 1/1987 | Worrell et al. | 312/196 |
| 4,668,026 | 5/1987 | Lapeyre et al. | 312/7.2 |
| 4,669,789 | 6/1987 | Pemberton | 312/7.2 |
| 4,712,842 | 12/1987 | Price et al. | 312/196 |
| 4,725,106 | 2/1988 | Shields et al. | 312/208 |
| 4,732,088 | 3/1988 | Koechlim et al. | 108/64 |
| 4,755,009 | 7/1988 | Price et al. | 312/194 |
| 4,766,422 | 8/1988 | Wolters et al. . | |
| 4,779,139 | 10/1988 | Lapeyre et al. . | |
| 4,784,445 | 11/1988 | Ott | 312/236 |
| 4,836,478 | 6/1989 | Sweere . | |
| 4,836,625 | 6/1989 | Catta | 312/257.1 |
| 4,861,121 | 8/1989 | Gotz | 312/208 |
| 4,884,773 | 12/1989 | Becker . | |
| 4,920,458 | 4/1990 | Jones . | |
| 4,932,332 | 6/1990 | Noda | 108/50 |
| 4,974,915 | 12/1990 | Bussard | 312/236 |
| 5,016,405 | 5/1991 | Lee | 52/36.1 |
| 5,027,718 | 7/1991 | Graham, Sr. | 108/64 |
| 5,037,164 | 8/1991 | Weissenbach et al. | 312/223.3 |
| 5,044,135 | 9/1991 | Kroon et al. | 52/239 |
| 5,071,204 | 12/1991 | Price et al. | 312/194 |
| 5,125,727 | 6/1992 | Lechman et al. | 312/194 |
| 5,199,773 | 4/1993 | Price, Jr. et al. | 312/194 X |
| 5,410,972 | 5/1995 | Schairbaum | 312/223.3 X |
| 5,438,937 | 8/1995 | Ball et al. | 108/64 |
| 5,699,225 | 12/1997 | Yavitz et al. | 312/223.3 X |
| 5,758,935 | 6/1998 | Coonan | 312/223.3 |

TRAPEZOIDAL HIDDEN-MONITOR COMPUTER DESK MODULES AND ASSEMBLIES THEREOF

CROSS-REFERENCE TO RELATED APPLICATIONS

The present application is a continuation application of an application entitled "TRAPEZOIDAL HIDDEN-MONITOR COMPUTER DESK MODULES AND ASSEMBLIES THEREOF", filed Aug. 11, 1997 and assigned Ser. No. 08/909,410, which is a continuation of an application entitled "TRAPEZOIDAL HIDDEN-MONITOR COMPUTER DESK MODULES AND ASSEMBLIES THEREOF", filed Apr. 19, 1995, assigned Ser. No. 08/424,955, now U.S. Pat. No. 5,655,822, issued Aug. 12, 1997, all of which describe invention by the present inventors.

BACKGROUND OF THE INVENTION

The invention relates to computer desks, and more particularly, to trapezoidal "hidden-monitor" desks which can be used interchangeably as ordinary desks and as computer desks, and can be assembled into various semi-octagonal, S-shaped, straight-line, and angular clusters so as to allow efficient use of classroom or office floor space and also provide an aesthetic classroom or office environment.

A wide variety of modular work stations are known. Some can be assembled into various aesthetically pleasing clusters. Most are designed primarily for industrial or commercial applications. Some of the known modular desks or computer work stations are non-rectangular. "Hidden-monitor" computer desks, such as the one shown in U.S. Pat. No. 4,755,009, include a computer monitor supported below a transparent monitor viewing window plate that is embedded in the desk top so the computer monitor can be viewed without occupying space on the desk top. The known hidden-monitor computer desks include a retractable keyboard shelf. None of the known hidden-monitor computer desks have non-rectangular desk tops, and none are non-rectangular modular units that can be linked together in a variety of different clusters which would be well suited for classroom or office use.

Thus, there is an unmet need for an inexpensive, hidden-monitor computer desk module that can, without modification, be used as an ordinary school or office desk, and also can be easily assembled into various clusters so as to make optimum use of classroom or office space, provide a variety of aesthetically pleasing arrangements, allow for more effective teacher-student interaction or work productivity, and provide a measure of individual privacy so as to allow a number of persons to use computers without distracting the others. There also is an unmet need for an effective yet attractive system for invisible routing of overhead electrical cables and computer bus or data cables to and between computer desk modules, shared printers, and/or other computer peripheral devices.

SUMMARY OF THE INVENTION

Accordingly, it is an object of the invention to provide a computer desk module that can be conveniently and easily assembled into attractive clusters so as to make efficient use of classroom or office floor space and also enhance student-teacher interaction or work-place productivity.

It is another object of the invention to provide a non-rectangular computer desk module and assembled clusters thereof and an attractive complementary system for invisible routing of overhead electrical cables and computer bus cables to all of the computer desk modules.

It is another object of the invention to provide a wide variety of clusters of inexpensive hidden-monitor computer desk modules.

It is another object of the invention to provide a computer desk module that provides convenient, versatile adjustment of the viewing angle of a "hidden" monitor located under the desk top and viewed through a window plate embedded in the desk top.

It is another object of the invention to provide a hidden-monitor computer desk module that can be assembled into clusters with good ventilation therein to effectuate cooling of computers and monitors in the computer desk modules.

Briefly described, and in accordance with one embodiment thereof, the invention provides a computer desk module, having a trapezoidal desk top with a monitor viewing window opening therein. The front edge of the trapezoidal desk top is longer than the rear edge thereof. A transparent monitor viewing window plate is supported in the desk top surface plate so as to cover the window opening. A flat top surface of the window plate is flush with a flat surface of the desk top. A pull-out keyboard 10 shelf is supported under a front edge portion of the desk top, and is secured behind a flip-down drawer. A left storage pedestal is bounded by a left side panel and a left knee space panel, and a right storage pedestal is bounded by a right side panel and a right knee space panel. A monitor compartment is bounded by the desk top, a back panel, the left and right side panels, and a hinged knee space door panel, the left and right knee space panels being parallel to the left and right side panels, respectively. A computer monitor can be supported in the monitor compartment so as to have an upwardly-inclined viewing screen to thereby allow viewing of the screen through the transparent monitor window plate by a person seated in front of the knee space. The trapezoidal shape of the computer desk modules allows them to be assembled in end-to-end fashion into semi-trapezoidal clusters, S-shaped clusters, and a variety of straight line clusters. A power cable and computer bus routing system includes tubular legs supporting a decorative cover extending to the ceiling of a room. The legs extend upward from a cabinet having a semi-octagonal shape dimensioned to mate with semi-octagonal clusters of the computer desk modules. Openings in the side panels of the computer desk modules that are connected end-to-end with other computer desk modules allow improved air circulation through all of them to thereby cool all of the hidden monitors.

BRIEF DESCRIPTION OF THE DRAWINGS

FIG. 6 is a partial section view illustrating a power and bus distribution system including a cabinet and printer stand.

DETAILED DESCRIPTION OF THE PREFERRED EMBODIMENTS

Figure 3:
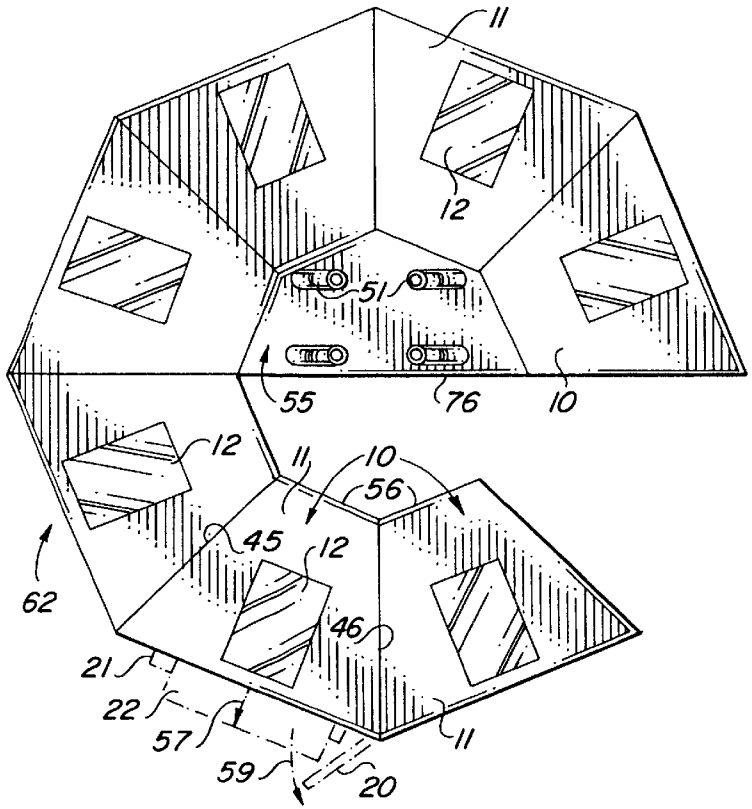
FIG. 3 is a partial plan view of a semi-octagonal cluster of computer desk modules, arranged slightly differently than in FIG. 1.
Figure 5:
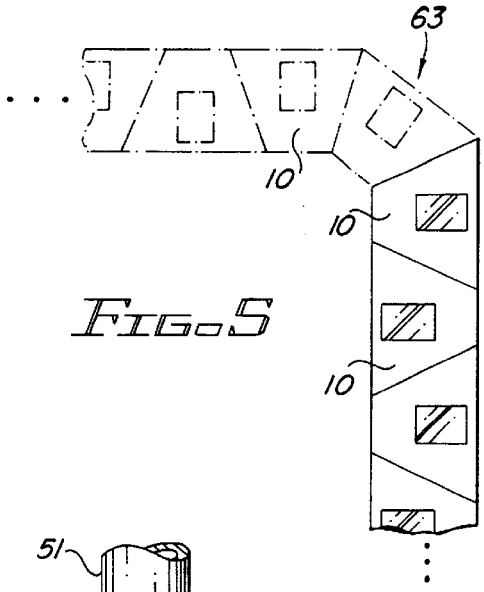
FIG. 5 illustrates another cluster of the trapezoidal computer desk modules of the present invention.
Figure 4:
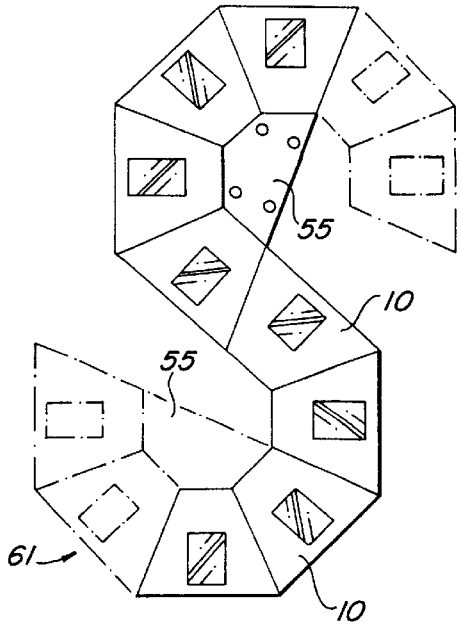
FIG. 4 is a plan view of an S-shaped cluster of the trapezoidal computer desk modules of the present invention.

Referring to the drawings, a cluster 1 of seven trapezoidal computer desk modules such as 10-1, 10-2, 10-3, etc. are adjoined and connected in end-to-end relationship by means of Chicago "through bolts", sometimes called "sex bolts". As shown in FIGS. 3–5, the desk top 11 of each of the computer desk modules 10-1,2 . . . 7 has a desk top 11 shaped as a symmetrical trapezoid. In the preferred embodiment, the rear edge 56 of each desk top 11 is approximately 18 inches long. Each left edge 45 and each right edge 46 of each desk top 11 is approximately 37 inches long, each front edge 47 is approximately 47 inches long. The height of the top surface of each desk top 11 is 31 inches above the floor which supports base 16. (The height of base 16 can be modified to provide a lower desk top surface for smaller students.) The base angles of the trapezoids formed by desk tops 11 are selected to be 67° 30', so that eight of the modules connected end-to-end can form an octagonal cluster.

Figure 2:
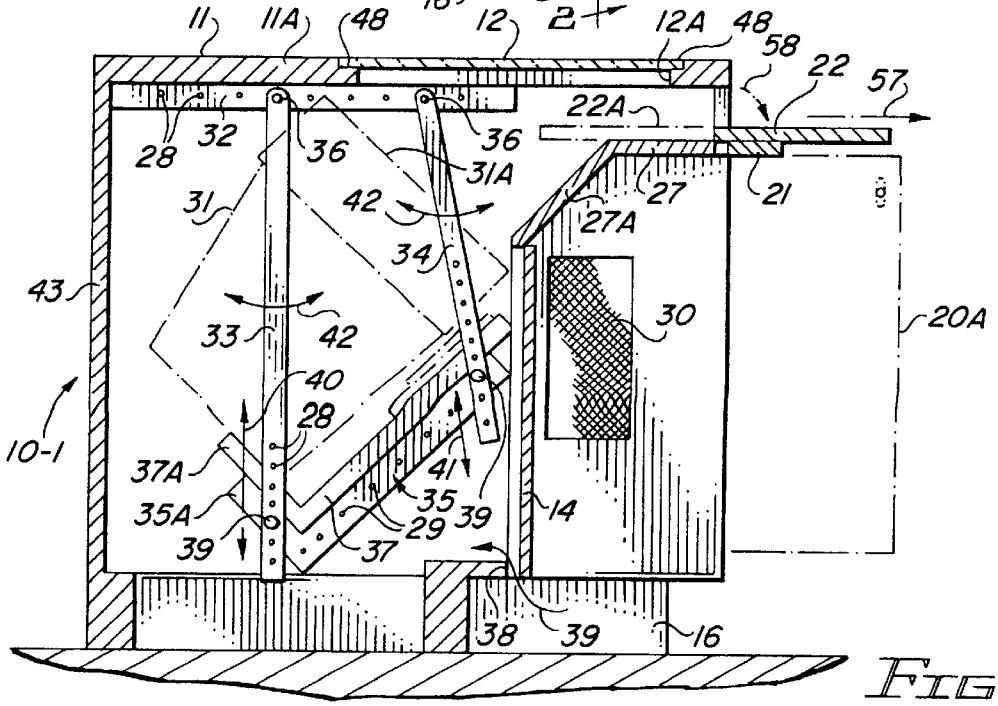
FIG. 2 is a partial section view taken along section line 2—2 of FIG. 1.

A transparent monitor-viewing window plate 12, preferably composed of quarter inch thick transparent gray-tinted safety glass, is supported in a quarter inch deep recess 48 around an opening 12A in each desk top 11, as shown in FIG. 2, so that the upper surface of each desk top 11 is flush with the upper surface of its window plate 12, set in clear waterproof sealant around the entire periphery thereof. Each window plate 12 thereby covers the window opening 12A. Preferably, each viewer monitoring window plate 12 has a length of approximately 18 inches and a width of approximately 13 inches, and its front edge is located approximately 2.5 inches from and is centered with respect to front edge 47 of the desk top 11.

Figure 10:
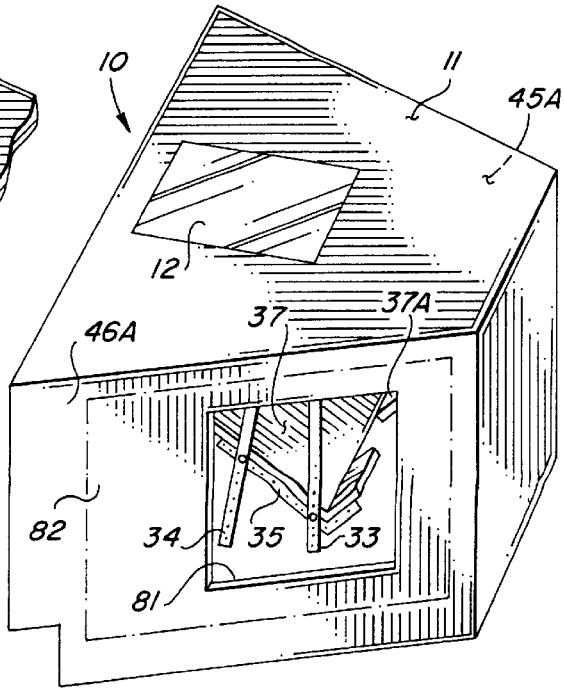
FIG. 10 is a perspective upper side view of one of the computer desk modules 10 of FIG. 1, showing a ventilation opening and a side cover plate therefor.

As shown in FIG. 2, computer desk module 10-1 has a monitor compartment in which a computer monitor indicated by dashed lines 31 can be adjustably suspended. The monitor compartment is bounded by the rear portion of desk top 11, a vertical rear panel 43 adjoining rear edge 56 of desk top 11, two vertical side panels 45A and 46A (FIG. 10) and a rear knee space door panel 14. Computer monitor 31 is supported in a cradle 37,37A including an inclined bottom plate 37 and a lower retaining lip 37A perpendicular thereto as shown in FIG. 10, such that the viewing screen 31A of computer monitor 31 is inclined at an adjustable viewing angle of approximately 30 to 60 degrees relative to desk top 11.

Cradle 37,37A is supported by and attached to a first pair of opposed brackets 35 (only one of which is shown in the section view of FIG. 2) and a second pair of opposed brackets 35A. Each of the brackets 35 and 35A can be composed of stock metal angle material or the like having a plurality of spaced holes 28 therein, at one inch centers as shown. A pair of opposed upper support members 32 (only one of which is shown in FIG. 2) are rigidly attached by means of screws to the bottom surface of desk top 11. Each has a plurality of spaced holes 28 located at one inch centers therein. A pair of opposed rear suspension arms 33 are pivotly connected by pins 36 extending through selected holes 28 to the corresponding upper support members 32, as shown. The lower end of each rear support arm 33 also has a plurality of spaced holes 28 therein, and a lower pivot pin 39 extends through one of the holes 28 of the corresponding bracket 35A. Similarly, each of a pair of front suspension arms 34 has an upper end pivotly connected to a forward portion of the corresponding upper support 32 by a pin 36 extending through a selected hole 28. The lower end portion of each front suspension arm 34 is pivotly connected by a pin 39 extending through one of its holes 28 and a hole 28 of the corresponding bracket 35.

The suspended brackets 35,35A and the monitor support plate or cradle 37,37A and hence monitor 31 are adjustable vertically in the directions indicated by arrows 40 and 41, and also can be adjusted forward or rearward by pivoting suspension arms 33 and 34 in the directions indicated by arrows 42. Larger adjustments in the position of computer monitor 31 can be accomplished by changing the locations of the various pivot pins 36 and 39 to different holes 28 of brackets 35,35A and/or different holes 28 of support members 32. Furthermore, the orientation angle of the computer monitor screen 31A relative to desk top 11 also can be conveniently and precisely adjusted to accommodate the viewing needs of various students. Tightening of bolts/pins 36 and 39 creates a sufficiently rigid connection to avoid any significant "swinging" of the suspended monitor.

Figure 1:
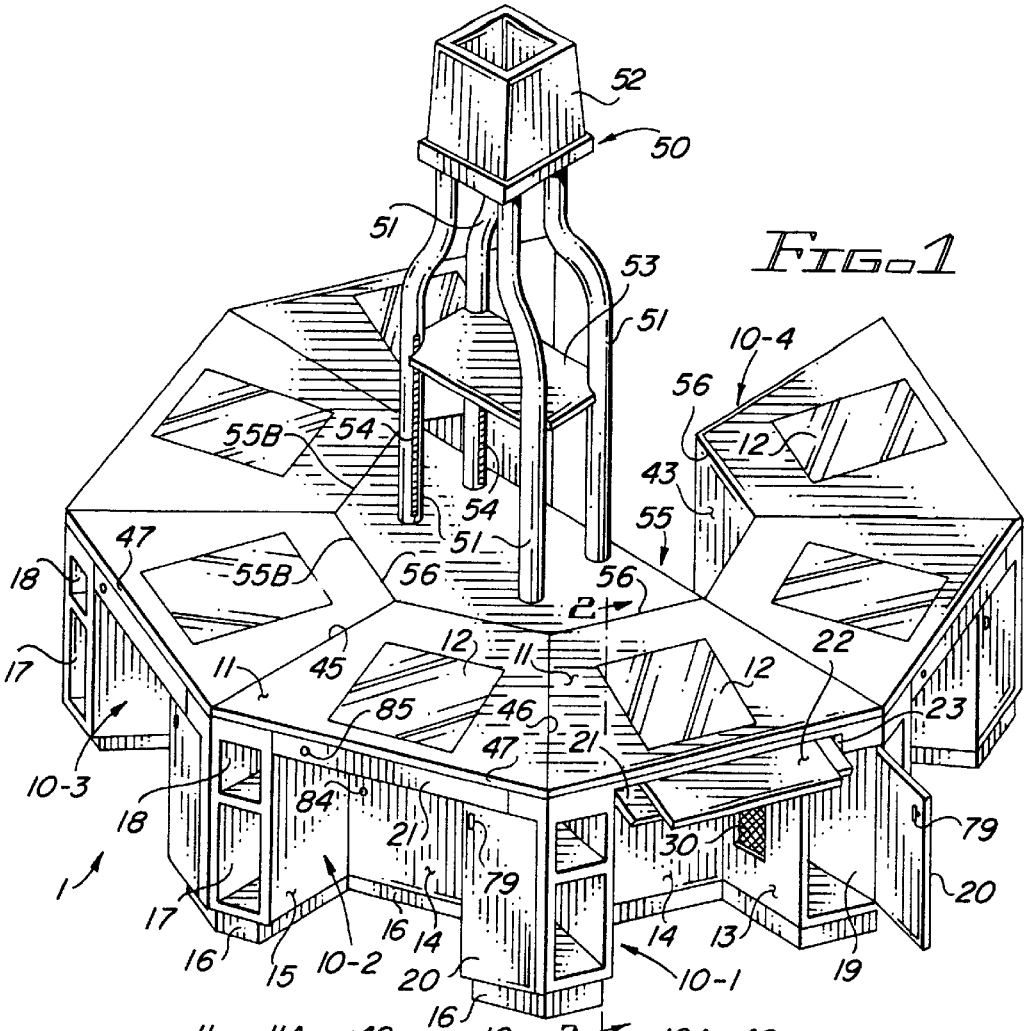
FIG. 1 is a perspective view of a cluster of computer desk modules and a complementary power and bus distribution system.

Each computer desk module 10 has a knee space bounded by vertical knee space door panel 14, a vertical right knee space panel 13 (as shown in computer desk module 10-1 in FIG. 1) and a vertical left knee space panel 15 (as shown in computer desk module 10-2 in FIG. 1). Knee space door panel 14 is hinged at one vertical edge thereof, can be opened to allow access to the monitor compartment, and has a security lock 84 adjacent to its other vertical edge. A gap 38 approximately one inch in width is provided along the bottom edge of door 14 to allow air flow as indicated by arrow 39 to improve ventilation of the monitor compartment. The upper portion of the knee space is bounded by a horizontal plate 27 and an inclined panel 27A, as shown in FIG. 2.

Left knee space panel 15 is parallel to left side panel 45A (FIG. 10), and right knee space panel 13 is parallel to right side panel 46A. Thus, left side panel 45A and left knee space panel 15 form a left "pedestal compartment" within which storage areas 17 and 18 are enclosed, for storing headphones, books, student supplies, etc. Each right side panel 46A and corresponding right knee space panel 13 form a right "pedestal compartment" that serves as a computer compartment 19 for holding a typical personal computer. A metal mesh plate 30 covers a ventilation opening in each right knee space panel 13. The rear end of each computer compartment 19 opens into the monitor compartment to aid in the ventilation thereof. Similar metal mesh plates separate the backs of storage areas 17 and 18 from the monitor compartment, to aid in ventilation thereof. A front door 20 with a security lock 79 thereon encloses computer compartment 19.

A keyboard compartment door 21 having a security lock 85 is connected to the front edge of plate 27 along its lower edge by spring-loaded hinges, and opens by swinging down as indicated by arc 58 in FIG. 2 to allow sliding keyboard shelf 22 to be withdrawn, as indicated by arrow 57. Keyboard shelf 22 is supported by a conventional top-mounted sliding drawer track mechanism and bracket (not shown) attached to the bottom of desk top 11 to slideably support keyboard shelf 22 above plate 27. Dashed lines 22A indicated the retracted position of keyboard shelf 22 extending partly into the keyboard compartment. It can be seen in FIG. 2 that when keyboard shelf 22 is fully withdrawn, no portion of it interferes with the student's view of monitor screen area 31A through window plate 12.

Figure 7:
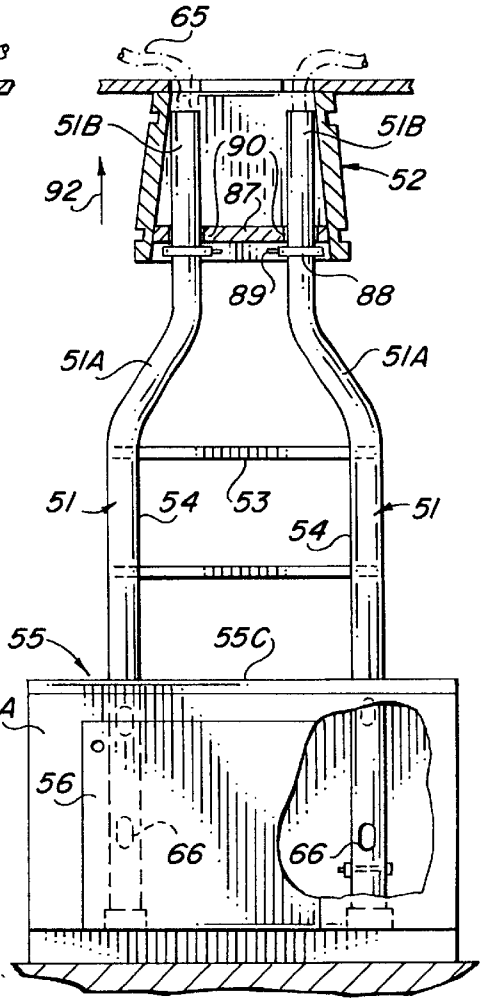
FIG. 7 is a partial cutaway elevation view of a front view of the power and bus distribution system shown in FIG. 1.
Figure 9:
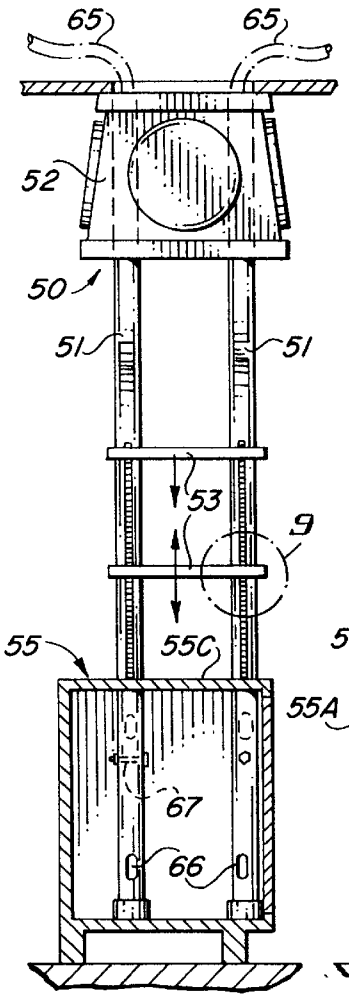
FIG. 9 is an enlarged view of detail 9 of FIG. 6 illustrating mounting of a printer shelf or the like between the tubular legs of the power distribution system of FIGS. 6 and 7.

In order to distribute power and bus cables to the personal computers in a group of computer desk modules 10 which are arranged in octagonal or semi-octagonal clusters as indicated in FIGS. 1, 3, and 4, a power distribution device 50, which the applicant refers to as a "power tower", is provided. Power distribution device 50 includes a decorative cover 52 the height of which is adjustable to abut the ceiling of a classroom, four height-adjustable tubular legs 51 the upper ends of which support cover 50 as indicated in FIGS. 6 and 7, one or more shelves 53, and a semi-octagonal cabinet 55 having a vertical flat front panel and four vertical rear panels indicated by numeral 55B in FIG. 1. The top surface 55C (FIG. 7) of cabinet 55 has a semi-octagonal shape that precisely mates with the rear edges 56 of the desk tops 11 of a number of computer desk modules 10 are arranged in a semi-octagonal (or octagonal) cluster. The top surface of printer cabinet 55 can be flush with or slightly higher than the upper surfaces of desk tops 11. (Slightly higher may be preferable, so as to allow the top of cabinet 55 to slightly overlap the upper surfaces of desk tops 11, to thereby avoid gaps between the top of cabinet 55 in the upper surfaces of desk tops 11.) As indicated in FIG. 6, one or more cables 65, which are routed through the ceiling of the classroom, can be passed through one or more of tubular legs 51, out of openings such as 66 in the legs 51 within cabinet 55 and routed from there to the various contiguous computer desk modules 10 that are connected end-to-end to form a semi-octagonal cluster such as 1, 61, or 62, and of course, to the personal computers and monitors therein.

Figure 8:
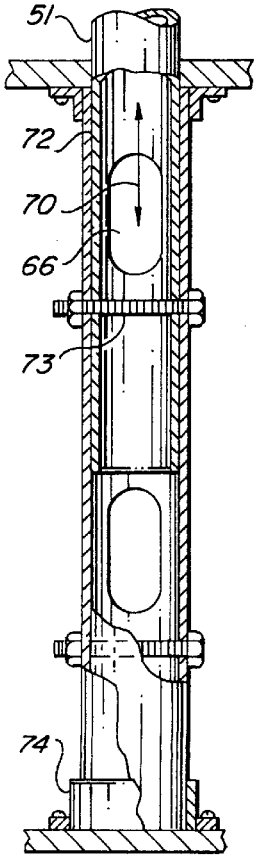
FIG. 8 illustrates a partial section view of a telescoping tube constituting one of the legs of the power and bus distribution system shown in FIGS. 6 and 7.
Figure 9:
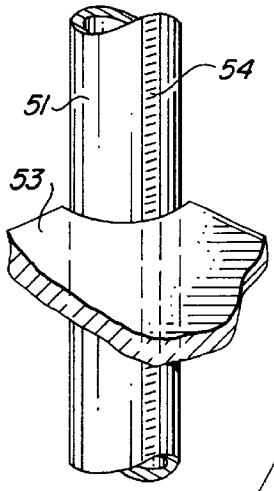

The lengths of legs 51 are adjustable by providing a telescoping feature which in the described embodiment is contained within cabinet 55 as shown in FIG. 8. The bottom end of each leg 51 telescopes into an outer tube 72, as best shown in FIG. 8. Cross bolts 73 inserted through selected aligned holes of outer tube 72 and leg 51 determine the height of the leg 51 such that decorative cover 52 can be adjusted to abut the ceiling of the classroom. The routing of cables 65 therefore is completely hidden from view.

Referring to FIG. 7, Cover 52 has a recessed bottom 87 having four clearance holes 90 therein through which the vertical upper portions 51B of legs 51 extend. Cylindrical retaining ring 88 each have a set screw 87 therein which when tightened anchors that slip ring to the corresponding leg 51. Accordingly, cover 52 can be adjusted upward as indicated by arrow 92 to abut the ceiling. Retaining ring 88 then can be slid upward to abut bottom 87, and set screws 87 can be tightened to retain cover 52 in place. Legs 51 include inclined portions 51A below the useful adjustment range of upper portion 51B of leg 51.

As indicated in FIGS. 1, 6, 7, and 9, conventional shelf standards 55 can be attached to the various legs 51 to receive support tabs and clips (not shown) that support the edges of one or more shelves 53 between legs 51. One or more printers or other computer peripheral devices can be supported on such shelves, or even within cabinet 55, which has an access door 56 (FIG. 7) with a suitable security lock. Cabinet 55 can have therein various shelves and storage compartments (not shown).

As mentioned above, a variety of clusters of classroom computer desk can be constructed using the trapezoidal computer desk modules 10. Examples include the semi-octagonal arrangements 1 and 62 of FIGS. 1 and 3, the semi-octagonal/S-shaped arrangement 61 shown in FIG. 4, and various straight-line and angled arrangement such as 63 in FIG. 5. The flexibility of the trapezoidal design is what allows such a variety of different shaped clusters of the computer desk modules 10 to be constructed, and power and bus conductors can be easily, invisibly routed to all of the computer desk modules in a particular cluster by virtue of the "mating" or complementary design of cabinet 55 of power distribution device 50. Preferably, various color combinations are provided using plastic laminate surfaces for the desk tops, their front and side panels, decorative cover 52, and cabinet 55.

As indicated in FIG. 10, each side panel 45A and 46A has a ventilation opening 81. For those of the computer desk modules 10 that are located at the "ends" of a cluster, the ventilation openings 81 preferably are covered by cover plates 82. Thus, although the computer desk modules 10 located at the ends of a cluster have their exposed side panels covered, air can flow freely through openings 81 all of the computer desk modules 10 throughout the cluster. If desired, an exhaust fan can be mounted in one or both of such cover plates 82 to enhance air circulation through all of the monitor compartments.

The described computer desk modules 10 function as everyday student desks to accommodate reading, writing, arts, crafts, etc., as desk tops 11 always remain free of a computer and monitor. When the monitor viewing window plates 12 are not being used as a desk top surface, they can be used without modification to view the monitor screen 31 as easily as if the monitor were on desk top 11. The various clusters can be flexibly designed both to allow the teacher to be more effective in assisting students to learn and to provide a desirable, ergonomic, aesthetically pleasing and "high tech"quality to the classroom environment. The computer hardware is always located beneath the desk tops and is easily locked up to prevent theft. The computers all can be easily connected to a LAN (local area network) system to enhance the overall teaching/learning process.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, the computer desk modules 10 can be used in an office environment as well as in a classroom environment as described. The trapezoidal configuration shown actually could be extended to form a triangle, with the front edges 47 having the same length as in the trapezoidal embodiment and the base angles being 67° 30' as in the trapezoidal embodiment so that semi-octagonal cluster arrangements could be assembled. The trapezoidal embodiment described herein may be referred to as "partially triangular", since if the sides of a trapezoid are extended to a vertex, a triangle is formed. Decorative cover 52 could be modified to include one or more monitors or video cassette players. Fewer than four legs such as 51, even as few as one leg could be provided for the power distribution assembly. Other monitor support devices than the one disclosed could be used.

What is claimed is:

1. A computer desk module having an interior space, said computer desk module comprising in combination:

(a) a desk top having front and rear edges and first and second side edges, the rear edge being shorter in length than the front edge;

(b) a transparent window plate included in said desk top for visual access to the interior space of said module;

(c) a plurality of panels disposed under said desk top, said desk top being rigidly secured to and immobile with said panels whereby said panels in combination with said desk top bounding a closed computer monitor compartment defining the interior space;

(d) one panel of said plurality of panels being movable to provide access to the interior space and including locking means for locking said one panel to prevent unauthorized access to any contents of said closed compartment; and (e) a computer monitor support disposed in said closed compartment and adapted to support a computer monitor so that a viewing screen thereof is upwardly-inclined to allow viewing of the screen through said window plate.

2. The computer desk module as set forth in claim 1 wherein said closed compartment is of sufficient size to accommodate housing a computer processing unit (CPU) in addition to the computer monitor.

3. The computer desk module as set forth in claim 1 including a pull-out keyboard shelf disposed beneath said desk top and proximate the front edge of said desk top.

4. The computer desk module as set forth in claim 1 including a storage pedestal disposed adjacent a panel of said panels proximate the first side edge of said desk top.

5. The computer desk module as set forth in claim 4 including a further storage pedestal disposed adjacent a panel of said panels proximate the second side edge of said desk top.

6. The computer desk module as set forth in claim 1 wherein said computer monitor support includes a cradle for supporting the computer monitor and a plurality of suspension arms for suspending said cradle from said desk top.

7. The computer desk module as set forth in claim 6 including support members secured to said desk top for securing said suspension arms to said desk top.

8. The computer desk module as set forth in claim 7 including adjustable pivot devices for repositioning said suspension arms to relocate said cradle forwardly and rearwardly.

9. The computer desk module as set forth in claim 6 including adjustable pivot devices for repositioning said suspension arms relative to said cradle and affect the angle of tilt of said cradle.

10. The computer desk module as set forth in claim 1 wherein the front and rear edges and the first and second side edges of said desk top define a trapezoidal configuration for said desk top.

11. The computer desk module as set forth in claim 10 wherein the trapezoidal configuration of said desk top includes base angles and wherein the base angles are about 67 degrees 30 minutes (67° 30').

12. A computer desk module having an interior space, said computer desk module comprising in combination:

(a) a desk top having front and rear edges and first and second side edges, the rear edge being shorter in length than the front edge, a pull-out keyboard shelf disposed beneath said desk top and proximate the front edge of said desk top, and a flip down door adapted for securing therebehind a keyboard on the keyboard shelf;

(b) a transparent window plate included in said desk top for visual access to the interior of said module;

(c) panels disposed under said desk top, said panels in combination with said desk top bounding a computer monitor compartment; and (d) a computer monitor support disposed in said monitor compartment and adapted to support a computer monitor so that a viewing screen thereof is upwardly-inclined to allow viewing of the screen through said window plate.

13. A computer desk module having an interior space, comprising in combination:

(a) a trapezoidal desk top having front and rear edges and equal length first and second side edges, the rear edge being shorter in length than the front edge;

(b) a transparent window plate included in said desk top for visual access to the interior space of said module;

(c) a plurality of panels secured to and depending from said desk top, said plurality of panels in combination with said desk top bounding a closed computer monitor compartment defining the interior space;

(d) one panel of said plurality of panels being movable to open said closed compartment and including locking means for locking said one panel to prevent unauthorized access to the contents of said closed compartment; and (e) a computer monitor support disposed in said closed compartment and adapted to support a computer monitor at an incline to locate a viewing screen thereof upwardly-inclined and allow viewing of the screen through said window plate.

14. The computer desk module as set forth in claim 13 wherein said computer monitor support includes a cradle for supporting the computer monitor.

15. The computer desk module as set forth in claim 14 including a plurality of suspension arms for suspending said cradle from said desk top.

16. The computer desk module as set forth in claim 15 including support members secured to said desk top for securing said suspension arms to said desk top.

17. The computer desk module as set forth in claim 15 including adjustable pivot devices for repositioning said suspension arms to relocate said cradle forwardly and rearwardly.

18. The computer desk module as set forth in claim 13 wherein the trapezoidal configuration of said desk top includes base angles and wherein the base angles are about 67 degrees 30 minutes (67° 30').

19. A plurality of work stations locatable adjacent one another to define a plurality of side-by-side work stations arranged in a continuous arc, said plurality of work stations comprising in combination:

I. each work station of said plurality of work stations including a computer desk module having an interior space comprising in combination:

(a) a trapezoidal desk top having front and rear edges and first and second side edges, the rear edge being shorter in length than the front edge;

(b) a transparent window plate included in said desk top for visual access to the interior space of said module;

(c) panels rigidly secured to and depending from said desk top, said panels in combination with said desk top bounding a closed computer monitor compartment defining the interior space to prevent unauthorized access to the contents of said closed compartment;

(d) one panel of said panels being selectively movable to provide access to the interior space of said closed compartment;

(e) a computer monitor support disposed in said closed compartment and adapted to support a computer monitor so that a viewing screen thereof is upwardly-inclined to allow viewing of the screen through said window plate;

II. each computer desk module of said plurality of computer desk modules being located adjacent at least one other computer desk module, each computer desk module being adapted to position a first side edge of one computer desk module essentially adjacent a second side edge of another computer desk module to locate the respective rear edges thereof end-to-end to define a segmented arc.

20. The work stations as set forth in claim 19 wherein the trapezoidal configuration of each of said desk tops includes base angles and wherein the base angles are about 67 degrees 30 minutes (67° 30') whereby four of said work stations define a segmented half-circle.

21. The work stations as set forth in claim 19 wherein the trapezoidal configuration of each of said desk tops includes base angles and wherein the base angles are about 67 degrees 30 minutes (67° 30') whereby eight of said work stations define a segmented circle.

22. A plurality of work stations locatable adjacent one another to define a plurality of rectilinearly arranged side-by-side work stations, said plurality of work stations comprising in combination:

I. each work station of said plurality of work stations including a computer desk module having an interior space comprising in combination:

(a) a trapezoidal desk top having front and rear edges and first and second side edges, the rear edge being shorter in length than the front edge;

(b) a transparent window plate included in said desk top for visual access to the interior space of said module;

(c) panels rigidly secured to and depending from said desk top, said panels in combination with said desk top bounding a closed computer monitor compartment defining the interior space to prevent unauthorized access to the contents of said closed compartment;

(d) one panel of said panels being selectively movable to provide access to the interior space of said closed compartment; and (e) a computer monitor support disposed in said closed compartment and adapted to support a computer monitor so that a viewing screen thereof is upwardly-inclined to allow viewing of the screen through said window plate;

II. each computer desk module of said plurality of computer desk modules being located adjacent at least one other computer desk module, each computer desk module being adapted to position a first side edge of one computer desk module essentially adjacent an equivalent first side edge of another computer desk module to align end-to-end alternating front and rear edges of the computer desk modules in a straight line.

* * * * *